US007743623B2

(12) United States Patent
Guarino et al.

(10) Patent No.: US 7,743,623 B2
(45) Date of Patent: Jun. 29, 2010

(54) ICE MAKING AND STORING SYSTEM

(75) Inventors: James Charles Leslie Guarino, Kalamazoo, MI (US); Marcus Roland Fischer, Stevensville, MI (US); Jeffrey J. Anselmino, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 193 days.

(21) Appl. No.: 11/939,605

(22) Filed: Nov. 14, 2007

(65) Prior Publication Data

US 2008/0148762 A1 Jun. 26, 2008

Related U.S. Application Data

(60) Provisional application No. 60/876,720, filed on Dec. 22, 2006.

(51) Int. Cl.
*F25C 5/18* (2006.01)
*F25D 23/00* (2006.01)

(52) U.S. Cl. ..... 62/344; 62/329

(58) Field of Classification Search ..... 62/344, 62/327, 329, 326, 382, 448, 449; 285/2, 285/5, 148.1, 397; 312/401–407.1, 321, 312/5, 306

See application file for complete search history.

(56) References Cited

U.S. PATENT DOCUMENTS 2,995,267 A 8/1961 Ostrander, Jr.
3,664,568 A 5/1972 MacDaniel
3,746,204 A 7/1973 Nagai
RE28,658 E 12/1975 MacDaniel
4,815,691 A * 3/1989 Cooley ..... 249/120
5,100,213 A * 3/1992 Vandarakis et al. ..... 312/405
5,678,725 A * 10/1997 Yamada et al. ..... 220/592.21
6,148,624 A * 11/2000 Bishop et al. ..... 62/137
D447,493 S 9/2001 Shelley et al.
6,425,259 B2 7/2002 Nelson et al.
6,442,954 B1 * 9/2002 Shapiro et al. ..... 62/137
2005/0160756 A1 7/2005 Lee et al.
2005/0229623 A1 10/2005 Kim
2006/0086130 A1 4/2006 Anselmino et al.
2006/0112715 A1 6/2006 Chung
2006/0174647 A1 8/2006 Kuehl et al.
2006/0201194 A1 9/2006 Bowen et al.
2006/0260343 A1 * 11/2006 Martin et al. ..... 62/340

* cited by examiner

*Primary Examiner*—Frantz F Jules
*Assistant Examiner*—Cassey Bauer
(74) *Attorney, Agent, or Firm*—Kirk W. Goodwin; Greer, Burns & Crain Ltd

(57) ABSTRACT

An ice making and storing system which may be mounted in a refrigeration appliance. The ice making and storing system includes an ice making mechanism, a removable ice storage receptacle positioned adjacent to the ice making mechanism, an insulated cover for the ice making mechanism with a portion engageable with the ice storage receptacle to provide a thermally tight seal between the cover and the ice storage receptacle.

20 Claims, 5 Drawing Sheets

ICE MAKING AND STORING SYSTEM

CROSS-REFERENCE TO RELATED APPLICATION

This application claims the benefit of U.S. provisional application Ser. No. 60/876,720, filed Dec. 22, 2006, which is incorporated herein in its entirety.

BACKGROUND OF THE INVENTION

Ice making and storing systems are known, particularly those used in refrigeration appliances. U.S. Pat. No. 6,148,624 discloses an ice making system which includes an ice bucket disposed beneath the icemaker. The ice bucket includes a window for viewing the quantity of accumulated ice in the bucket. U.S. Pat. No. 6,425,259 discloses a removable ice bucket with an upper body formed from a clear plastic material such that the quantity of ice pieces stored within the ice bucket can be visually determined.

U.S. Patent Application Pub. No. 2005/0201194 discloses a refrigerator with a water and ice dispenser that has an ice chute air seal. U.S. Patent Application Pub. No. 2006/0086130 is directed to an ice and water dispenser having an insulated cover to substantially enclose an icemaker. Another insulated cover substantially encloses an ice cube storage bin and an ice dispenser. U.S. Pat. No. 3,746,204 discloses a hollow, double walled ice bucket.

It would be an improvement in the art if there were provided an ice making and storing system which provides insulation for the ice maker and allows easy removal of the ice storage receptacle, yet also permits insulation of the storage receptacle and viewing of the ice level in the storage receptacle.

SUMMARY OF THE INVENTION

The present invention provides an ice making and storing system which, in some embodiments, may be mounted in a refrigeration appliance.

In an embodiment of the invention, an ice making and storing system includes an ice making mechanism, a removable ice storage receptacle positioned below the ice making mechanism, an insulated cover for the ice making mechanism, and a movable chute extending between the insulated cover and the ice storage receptacle having a portion engageable with the ice storage receptacle to provide a thermally tight seal between the chute and the ice storage receptacle.

In an embodiment, the movable chute is vertically slidable relative to the cover and the receptacle.

In an embodiment, the ice storage receptacle includes a top opening and the movable chute portion comprises a flange sized and arranged to surround the top opening.

In an embodiment, the flange includes an elastomeric or polyurethane foam seal member.

In an embodiment, the chute further includes a lip portion sized and arranged to extend into the top opening.

In an embodiment, the ice storage receptacle comprises a clear portion to permit viewing of a level of ice held in the receptacle.

In an embodiment, the ice storage receptacle is insulated.

In an embodiment, the ice storage receptacle is formed with a double wall and an insulating gas in a sealed space between the double walls.

In an embodiment of the invention, an ice making and storing system includes an ice making mechanism, an ice storage receptacle positioned adjacent to the ice making mechanism, and an insulated cover for the ice making mechanism having a portion engageable with the ice storage receptacle to provide a thermally tight seal between the cover and the ice storage receptacle.

In an embodiment, the insulated cover encloses the ice making mechanism and not the ice storage receptacle.

In an embodiment, the ice storage receptacle is removable from below the ice making mechanism.

In an embodiment, the ice storage receptacle includes a top opening and the insulated cover comprises a flange sized and arranged to surround the top opening.

In an embodiment, the flange includes an elastomeric or polyurethane foam seal member.

In an embodiment, the cover further includes a lip portion sized and arranged to extend into the top opening.

In an embodiment, the ice storage receptacle comprises a clear plastic portion to permit viewing of a level of ice held in the receptacle.

In an embodiment, the ice storage receptacle is insulated.

In an embodiment, the ice storage receptacle is formed with a double wall and an insulating gas in a sealed space between the double walls.

In an embodiment of the invention, a refrigeration appliance includes a refrigerated compartment to be maintained at a temperature above the freezing point of water, an ice making mechanism located within the refrigerated compartment, an ice storage receptacle positioned adjacent to the ice making mechanism and also located within the refrigerated compartment, and an insulated cover positioned between the ice making mechanism and the remainder of the refrigerated compartment, and having a portion engageable with the ice storage receptacle to provide a thermally tight seal between the cover and the ice storage receptacle.

DETAILED DESCRIPTION OF THE PREFERRED EMBODIMENT

Figure 1:
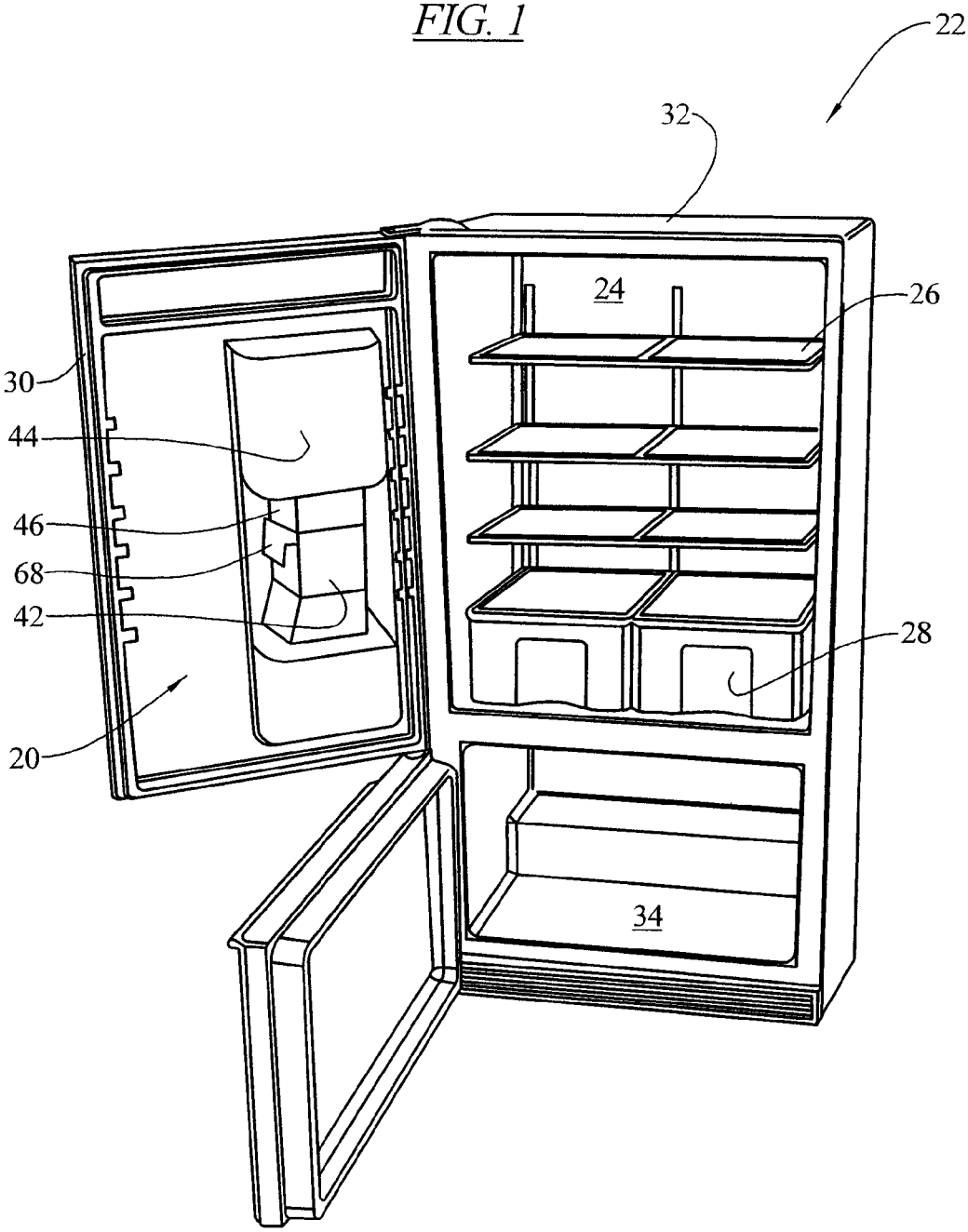
FIG. 1 is a front elevational view of a refrigeration appliance incorporating an ice making and storing system embodying the principles of the present invention.

As illustrated in FIG. 1, the present invention provides an ice making and storing system 20 which, in some embodiments, may be mounted in a refrigeration appliance 22. In the embodiment shown in FIG. 1, the refrigeration appliance 22 includes a refrigerated compartment 24 to be maintained at a temperature above the freezing point of water. In this compartment may be located various shelves 26 and drawers 28 for storing food items. The ice making and storing system 20 may be located on a door 30 of the cabinet 32 of the appliance 22, as shown, or it may be located in the main refrigerated compartment 24. The refrigeration appliance 22 may also include a separate compartment 34 which could be maintained at a temperature below the freezing point of water, and the ice making and storage system 20 could be located in that compartment as well. Further, although the refrigeration appliance 22 is illustrated as a bottom freezer mount refrigerator, the present invention could also be used in a side-by-side type refrigerator/freezer.

Figure 2:
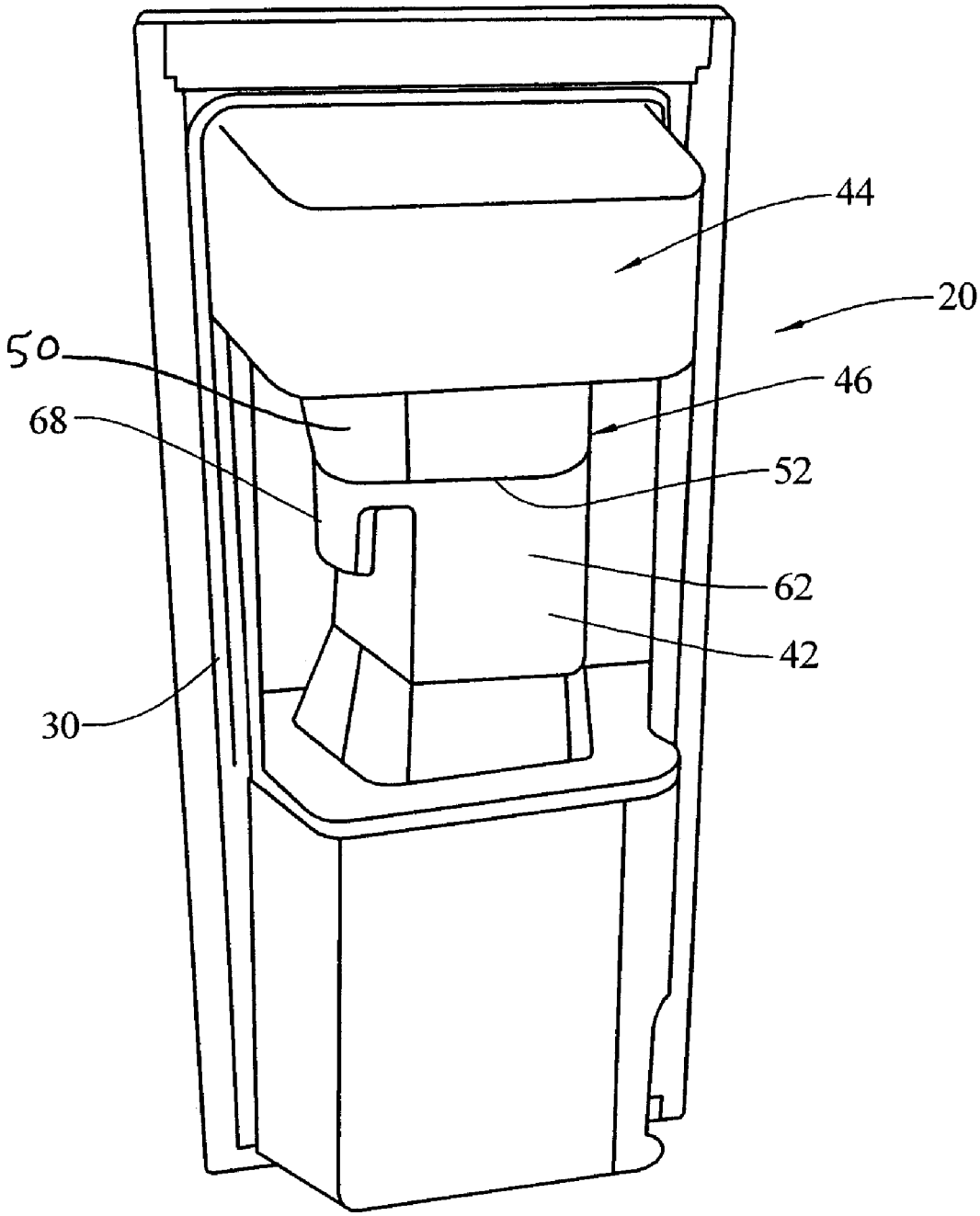
FIG. 2 is an enlarged front perspective view of the ice making and storing system in an operational condition.
Figure 3:
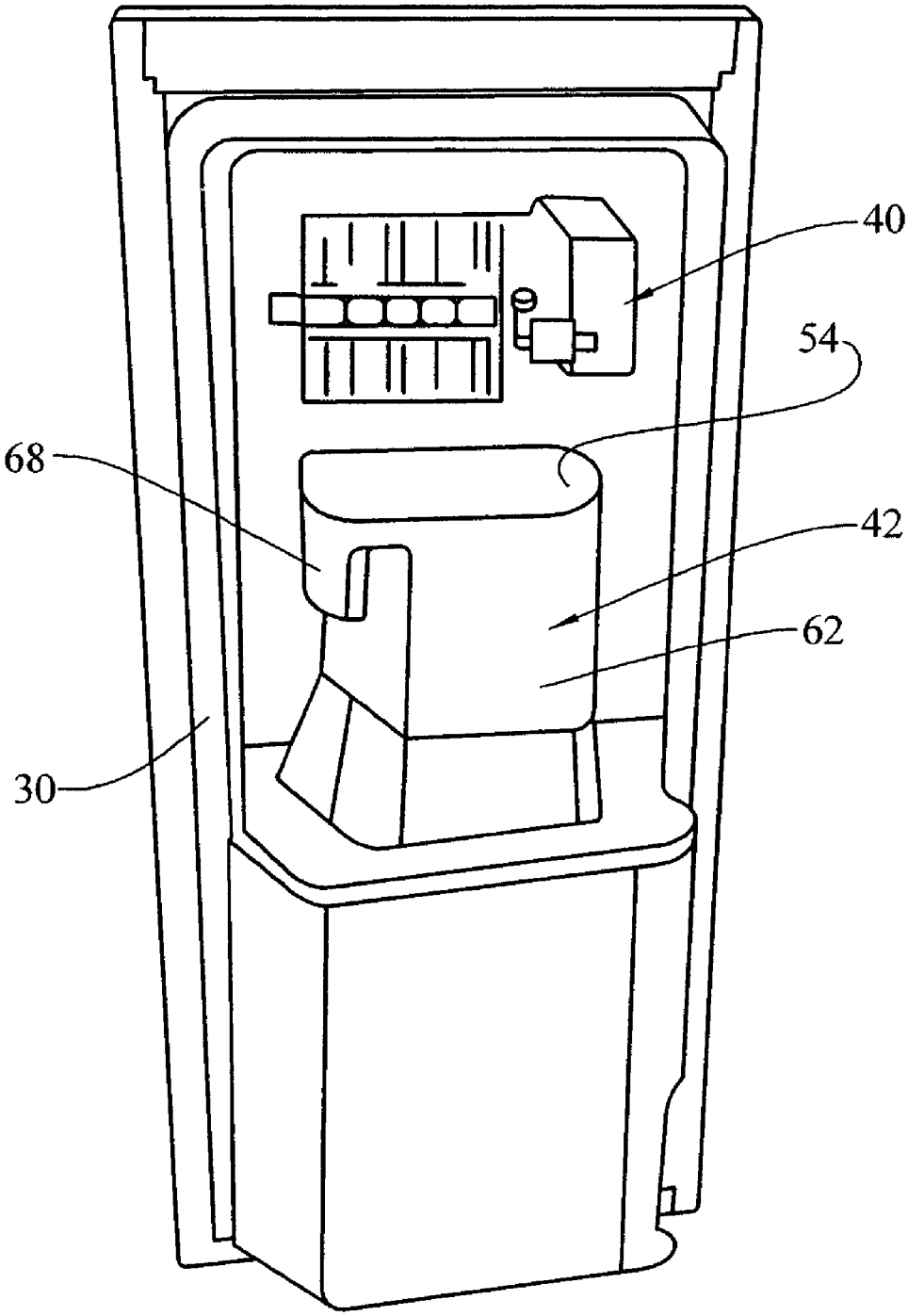
FIG. 3 is an enlarged front perspective view of the ice making and storing system with the insulating cover and chute removed.

As shown in greater detail in FIGS. 2 and 3, the ice making and storage system 20 includes an ice making mechanism 40. An ice storage receptacle 42 is positioned adjacent to the ice making mechanism 40, such as below the ice making mechanism. An insulated cover 44 is positioned between the ice making mechanism 40 and the remainder of the refrigerated compartment 24. The insulated cover 44 has a portion 46 engageable with the ice storage receptacle 42 to provide a thermally tight seal between the cover and the ice storage receptacle. When the ice making and storage system 20 is positioned within the refrigeration compartment 24, which is maintained at a temperature above freezing, then the insulated cover 44 prevents the below freezing temperature maintained in the ice making mechanism 40 and in the ice storage receptacle 42 from chilling the remainder of the refrigerated compartment. Even if the ice making and storage system 20 is positioned within a freezer compartment 34, the cover 44 and its sealed connection to the ice storage receptacle 42 will allow the temperature and humidity within the ice storage receptacle to be maintained at the proper conditions to maximize the storage time for the ice held in the receptacle.

In an embodiment of the invention, the portion 46 of the insulated cover 44 may comprise a movable chute 50 extending between the insulated cover and the ice storage receptacle 42 which has an edge portion 52 engageable with the ice storage receptacle to provide a thermally tight seal and perhaps in some embodiments, an air-tight seal, between the chute and the ice storage receptacle.

Figure 4:
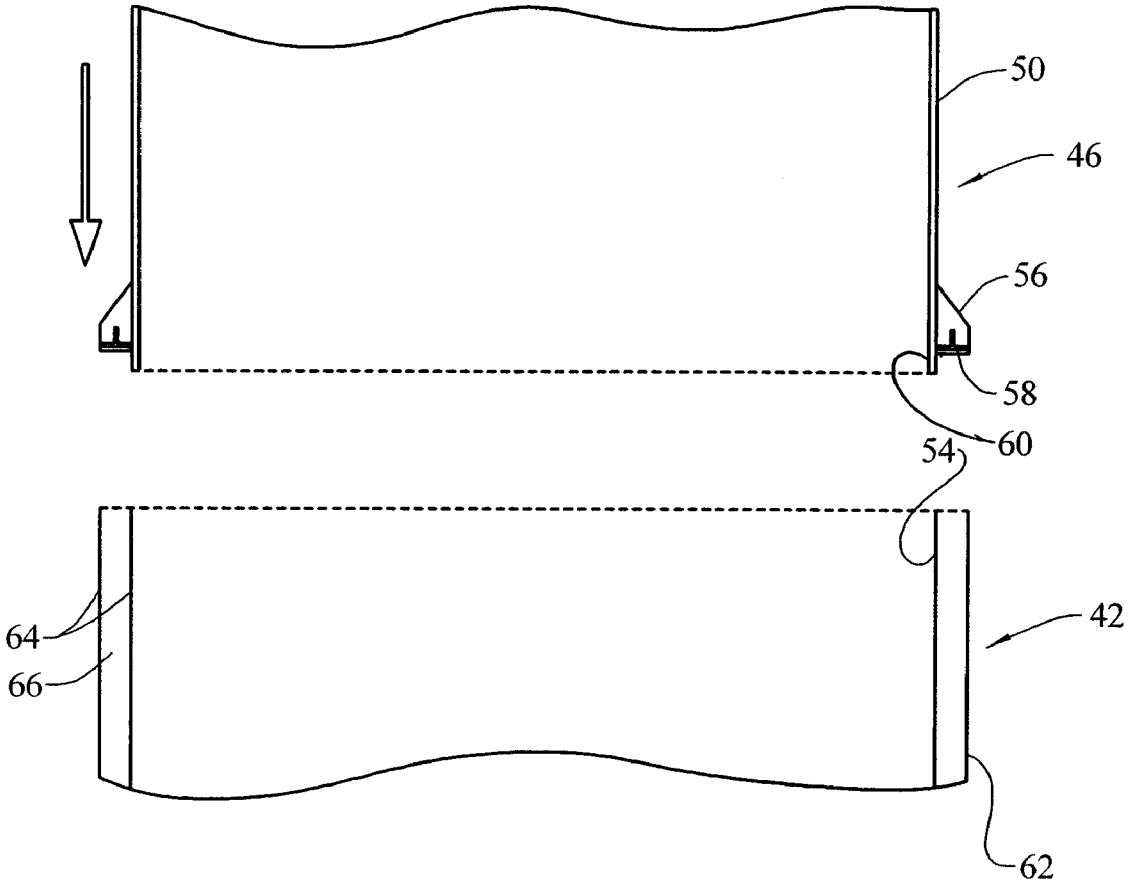
FIG. 4 is a partial side sectional view of the ice receptacle and the chute in a disengaged position.
Figure 5:
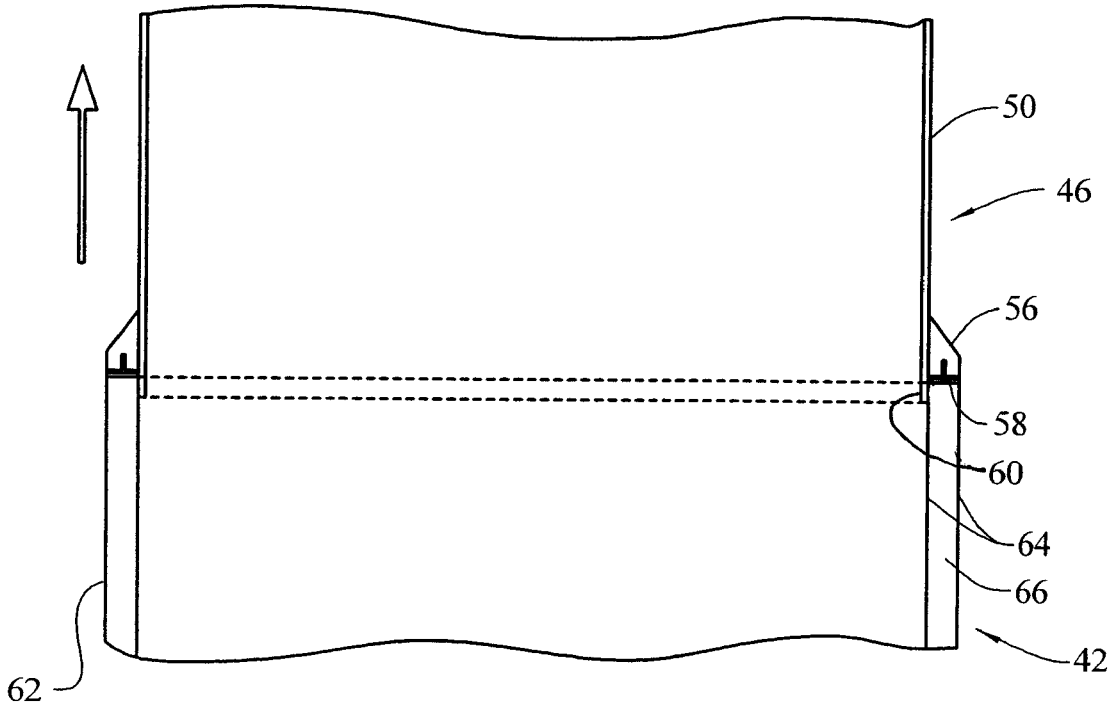
FIG. 5 is a partial side sectional view of the ice receptacle and the chute in an engaged position.

The movable chute 50 may be vertically slidable relative to the cover 44 and the receptacle 42, particularly when the receptacle is positioned below the ice making mechanism 40. As shown in the embodiment of FIGS. 4 and 5, the ice storage receptacle 42 may include a top opening 54 and the movable chute portion 46 may include a flange 56 sized and arranged to surround the top opening. The flange 56 may include an elastomeric or polyurethane foam seal member 58 to enhance the seal between the chute 50 and the receptacle 42. The seal member 58 may be made out of other resilient materials as well.

In an embodiment, the chute 50 may include a lip portion 60 sized and arranged to extend into the top opening to form a labyrinth seal to enhance or in lieu of the seal member 58. In other embodiments, the flange 56, seal member 58 and lip portion 60 may be provided on the ice storage receptacle 42, for engagement with the chute 50.

The ice storage receptacle 42 may include a clear portion 62 to permit viewing of a level of ice held in the receptacle. The clear portion 62 may be in the form of a window, or may include the entire body of the receptacle 42.

The ice storage receptacle 42 may be insulated, particularly if the ice forming and storing system 20 is positioned in the refrigerated compartment 24. In one embodiment, the ice storage receptacle 42 may be formed with a double wall 64 (FIGS. 4 and 5) and an insulating gas in a sealed space 66 between the walls. The gas in the space 66 might be air or a heavy gas, such as argon. The space 66 might also be evacuated so that the pressure of the gas in the space is below atmospheric pressure. Alternatively, the space 66 could be filled with a solid insulation material.

In an embodiment where the receptacle 42 itself is insulated, or in other embodiments, the insulated cover 44 may be sized to enclose the ice making mechanism 40 and not the ice storage receptacle.

The ice storage receptacle 42 may be removable from below the ice making mechanism 40. In such an arrangement, the receptacle may be provided with a handle 68 to enhance the ability of the user to grasp the receptacle. When the receptacle 42 is removable, the chute 50 would be slid upwardly to disengage the seal between the chute and the receptacle 42, thereby allowing the receptacle to be easily removed from the refrigeration appliance 22. When the receptacle 42 is replaced, the chute 50 would be slid upwardly to permit the receptacle to be put into place, and then the chute would be moved downwardly to engage the flange 56 with the receptacle 42 to reestablish the thermal seal.

Various features of the ice forming and storing system 20 have been described which may be incorporated singly or in various combinations into a desired system.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim:

1. An ice making and storing system comprising:

an ice making mechanism, a removable ice storage receptacle positioned below the ice making mechanism, the receptacle having a top opening defined by a top edge, an insulated cover for the ice making mechanism, and a chute movable between an open position and a closed position extending between the insulated cover and the ice storage receptacle having a bottom edge sized to telescopically engage with the top edge of the receptacle such that the top and bottom edges overlap in the closed position of the chute, and interfering elements positioned on the chute and the receptacle to define the closed position of the chute relative to the receptacle once the edges have been moved into an overlapping position, wherein a thermally tight seal is formed between the chute and the ice storage receptacle when the chute is in the closed position.

2. The ice making and storing system according to claim 1, wherein the movable chute is vertically slidable relative to the cover and the receptacle.

3. The ice making and storing system according to claim 1, wherein the interfering elements comprise a flange carried on the chute sized and arranged to overlie and engage the top edge of the receptacle.

4. The ice making and storing system according to claim 3, wherein the flange includes a resilient seal member.

5. The ice making and storing system according to claim 4, wherein the chute further includes a lip portion defining the bottom edge of the chute sized and arranged to extend into the top opening.

6. The ice making and storing system according to claim 1, wherein the ice storage receptacle comprises a clear portion to permit viewing of a level of ice held in the receptacle.

7. The ice making and storing system according to claim 1, wherein the ice storage receptacle is insulated.

8. The ice making and storing system according to claim 7, wherein the ice storage receptacle is formed with a double wall and an insulating gas in a sealed space between the double walls.

9. An ice making and storing system comprising:

an ice making mechanism, an ice storage receptacle positioned adjacent to the ice making mechanism and having an opening defined by an edge, an insulated cover enclosing the ice making mechanism and not the ice storage receptacle but having a portion movable between an open position and a closed position with an opening defined by an edge telescopically engageable with the ice storage receptacle such that the edges of the receptacle and the cover portion overlap when the cover portion is in the closed position to provide a thermally tight labyrinth seal between the cover and the ice storage receptacle, and interfering elements positioned on the cover portion and the receptacle to define the closed position of the cover portion relative to the receptacle once the edges have been moved into an overlapping position.

10. The ice making and storing system according to claim 9, wherein the ice storage receptacle is removable from below the ice making mechanism.

11. The ice making and storing system according to claim 9, wherein the insulated cover comprises a flange sized and arranged to surround and engage the receptacle opening.

12. The ice making and storing system according to claim 11, wherein the flange includes a resilient seal member.

13. The ice making and storing system according to claim 11, wherein the cover further includes a lip portion sized and arranged to extend into the receptacle opening.

14. The ice making and storing system according to claim 9, wherein the ice storage receptacle comprises a clear plastic portion to permit viewing of a level of ice held in the receptacle.

15. The ice making and storing system according to claim 9, wherein the ice storage receptacle is insulated.

16. The ice making and storing system according to claim 15, wherein the ice storage receptacle is formed with a double wall and an insulating gas in a sealed space between the double walls.

17. A refrigeration appliance comprising:

a refrigerated compartment to be maintained at a temperature above the freezing point of water, an ice making mechanism located within the refrigerated compartment, an ice storage receptacle positioned adjacent to the ice making mechanism and also located within the refrigerated compartment, the receptacle having an opening defined by an edge, an insulated cover enclosing and thermally isolating the ice making mechanism and not the ice storage receptacle from the refrigerated compartment, but having a portion movable between an open position and a closed position with an opening defined by an edge telescopically engageable with the ice storage receptacle such that the edges of the receptacle and the cover portion overlap when the cover portion is in the closed position to provide a thermally tight labyrinth seal between the cover and the ice storage receptacle, and interfering elements positioned on the cover portion and the receptacle to define the closed position of the cover portion relative to the receptacle once the edges have been moved into an overlapping position.

18. The refrigeration appliance according to claim 17, wherein the ice storage receptacle is formed with a double wall and an insulating gas in a sealed space between the double walls.

19. The refrigeration appliance according to claim 17, wherein the insulated cover comprises a movable chute with a flange sized and arranged to surround and engage the receptacle opening.

20. The refrigeration appliance according to claim 17, wherein the cover further includes a lip portion sized and arranged to extend into the receptacle opening.

* * * * *